US007986901B2

(12) United States Patent
Nishimura

(10) Patent No.: US 7,986,901 B2
(45) Date of Patent: Jul. 26, 2011

(54) IMAGE FORMING APPARATUS

(75) Inventor: Soichiro Nishimura, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 12/656,308

(22) Filed: Jan. 25, 2010

(65) Prior Publication Data

US 2010/0150611 A1 Jun. 17, 2010

Related U.S. Application Data

(62) Division of application No. 12/003,840, filed on Jan. 2, 2008, now Pat. No. 7,680,432, which is a division of application No. 11/019,784, filed on Dec. 23, 2004, now Pat. No. 7,362,987.

(30) Foreign Application Priority Data

Dec. 24, 2003 (JP) ..... 2003-427875

(51) Int. Cl.
*G03G 21/18* (2006.01)
*G03G 15/04* (2006.01)

(52) U.S. Cl. ..... 399/112; 399/189

(58) Field of Classification Search ..... 399/111, 399/112, 113, 114, 189, 223, 226, 227, 380
See application file for complete search history.

(56) References Cited

U.S. PATENT DOCUMENTS

| | | | | |
|---|---|---|---|---|
| 5,075,875 | A | | 12/1991 | Love et al. |
| 5,235,383 | A | * | 8/1993 | Tada et al. ..... 399/112 |
| 5,249,026 | A | | 9/1993 | Kojima |
| 5,784,094 | A | | 7/1998 | Ota et al. |
| 5,797,069 | A | | 8/1998 | Kimura et al. |
| 6,061,079 | A | | 5/2000 | Ota et al. |
| 6,151,459 | A | | 11/2000 | Hashimoto et al. |
| 6,240,271 | B1 | | 5/2001 | Shimazawa et al. |
| 6,560,416 | B2 | | 5/2003 | Fischer |
| 6,600,881 | B2 | | 7/2003 | Cornelius |
| 6,708,011 | B2 | | 3/2004 | Nomura et al. |
| 6,721,521 | B2 | | 4/2004 | Kataoka et al. |
| 6,987,594 | B2 | | 1/2006 | Takayama |
| 7,382,988 | B2 | | 6/2008 | Nakazato |
| 2001/0019418 | A1 | | 9/2001 | Kataoka et al. |
| 2003/0068173 | A1 | | 4/2003 | Tanizaki et al. |

FOREIGN PATENT DOCUMENTS

| | | |
|---|---|---|
| JP | A-8-115042 | 5/1996 |
| JP | A-2001-158131 | 6/2001 |
| JP | A-2001-249517 | 9/2001 |
| JP | B2-3257646 | 12/2001 |
| JP | A-2003-066683 | 3/2003 |
| JP | A-2003-255665 | 9/2003 |

* cited by examiner

*Primary Examiner* — Hoai-An D Nguyen
(74) *Attorney, Agent, or Firm* — Oliff & Berridge, PLC

(57) ABSTRACT

An image forming apparatus having removable/replaceable process cartridges is provided. One of the removable/replaceable process cartridges is removed/replaced from a panel which is different than a panel from which the other removable/replaceable process cartridges is removed/replaced. One of the removable/replaceable process cartridges is associated with an exposure device which is only used to expose a portion of that process cartridge while the other removable/replaceable process cartridges are associated with at least one other exposure device. An image forming apparatus may include two or more different types of exposure devices. An image forming apparatus includes a plurality of guide members for guiding portions of an exposure device arranged on a panel of the image forming apparatus such that when the door or panel is arranged on the image forming apparatus, the exposure device is guided into position by the guide members.

7 Claims, 7 Drawing Sheets

IMAGE FORMING APPARATUS

INCORPORATION BY REFERENCE

This is a Division of application Ser. No. 12/003,840 filed Jan. 2, 2008, now U.S. Pat. No. 7,680,432; which in turn is a Division of application Ser. No. 11/019,784 filed Dec. 23, 2004, now U.S. Pat. No. 7,362,987; which claims priority from Japanese Patent Application No. 2003-427875, filed on Dec. 24, 2003. The disclosure of the prior applications is hereby incorporated by reference herein in its entirety.

BACKGROUND

Tandem type electrophotographic color laser image forming devices (e.g., printers) are known. Such printers include a plurality of image forming units each of which is specific for one of the plurality of colors (e.g., yellow, magenta, cyan and black) and the image forming units are arranged in tandem (i.e., series). Each of the image forming units is generally made up of a laser scanner and an electrophotographic process device. The laser scanner is typically used to generate, modulate and deflect a laser beam to form an electrostatic latent image on a photosensitive member, and the electrophotographic process device develops the formed electrostatic latent image into a visual image. Each color image developed on the photosensitive member of each image forming unit is sequentially transferred and overlaid one over the other on a sheet of paper in order to form a full-color image.

As the tandem printer generally employs a plurality of image forming units (e.g., four image forming units corresponding to four different colors (e.g., yellow, magenta, cyan and black)), the printer size and the manufacturing cost of such printers tend to be higher than monochromatic printers.

U.S. Pat. No. 5,784,094 discloses a tandem type printer in which a laser scanner is shared among all the image forming units in order to provide a smaller tandem type printer. Specifically, the printer disclosed therein is designed such that four laser beams that are modulated according to image data for each color are directed to one polygon mirror, and the beams deflected by the polygon mirror are led to respective photosensitive members provided in the electrophotographic process device associated with each color.

SUMMARY

In particular, the printer disclosed in U.S. Pat. No. 5,784,094 is structured such that the four laser beams are deflected by a single polygon mirror. To accurately direct each laser beam deflected by the polygon mirror to the corresponding one of the photosensitive members, optically high-quality dimensional accuracy is required and thus, the cost of manufacturing such a printer is increased.

If an inexpensive optical system is employed for directing each laser beam deflected by the same polygon mirror to the corresponding one of the photosensitive members, the cost of such a printer can be reduced, but the quality of images formed thereby is reduced.

Generally, all processing devices or components are installed from a same vantage point of the printer and/or from a same direction. Black processing devices are typically replaced at a higher frequency than processing devices for the other colors. When a processing device is removed from a printer in order to provide a replacement therefor, one or more of the other processing devices may be dislodged, moved etc., and such an interference with an installed processing device may adversely affect the positional state of one or more of the processing devices.

According to an aspect of the invention, an image forming apparatus comprising a primary cartridge containing a primary developer of a primary color, at least one secondary cartridge containing a secondary developer of a color other than the primary color, primary cartridge replacing means for replacing the primary cartridge, and secondary cartridge replacing means for replacing the secondary cartridge is provided. The primary cartridge replacing means is independent of the secondary cartridge replacing means such that the primary cartridge cannot be replaced via the secondary cartridge replacing means and the secondary cartridge cannot be replaced via the primary cartridge replacing means.

According to another aspect of the invention, an image forming apparatus, comprising a primary process cartridge for a primary color, the primary process cartridge including a photosensitive member, at least two secondary process cartridges for at least two secondary colors, a primary exposure device, and a secondary exposure device is provided. Each of a plurality of secondary process cartridges includes a photosensitive member such that each photosensitive member is associated with one secondary color, and each secondary color is a color other than a primary color. The primary exposure device includes a primary laser emitting member and a primary deflector, the primary laser emitting member emits a laser beam based on image data of the primary color and the primary deflector deflects the laser beam emitted from the primary laser emitting member to a photosensitive member of a primary process cartridge. The secondary exposure device includes a secondary laser emitting member and a secondary deflector, wherein the secondary laser emitting member emits a different laser beam for each secondary color, based on image data for each secondary color, and the secondary deflector deflects each of the different laser beams such that each of the different laser beams is directed to a photosensitive member associated therewith.

An image forming apparatus, comprising a first exposure device, a first panel which may be opened or removed to access an internal space of the image forming apparatus and a plurality of guide members is provided. The first exposure device includes a light emitting device, each light emitting device is associated with one of a plurality of photosensitive members and includes a plurality of light emitting diodes, and the light emitted from each of the light emitting devices exposes the photosensitive member associated therewith. The first exposure device is arranged on an inner surface of the first panel such that when the first panel is arranged on the image forming apparatus, the first exposure device is arranged within an internal space of the image forming apparatus. Each of a plurality of guide members receives and guides one of the light emitting devices into position relative to the photosensitive member associated therewith when the panel is arranged on the image forming apparatus.

An image forming apparatus, comprising a first panel for accessing an internal space of the image forming apparatus, a second panel for accessing the internal space of the image forming apparatus, a primary process cartridge for processing a primary color and being removable from the first panel, a plurality of secondary process cartridges, a primary exposure device and a secondary exposure device is provided. Each of a plurality of secondary process cartridges processes a secondary color and is removable from the second panel such that when the secondary process cartridge is removed, a position of a primary process cartridge is minimally affected, and when the primary process cartridge is removed via a first panel, a position of each of the secondary process cartridges is minimally affected. The primary exposure device includes a primary laser emitting member and a primary deflector, the primary laser emitting member emits a laser beam based on image data of a primary color and the primary deflector deflects the laser beam emitted from the primary laser emitting member to a photosensitive member of the primary process cartridge. The secondary exposure device includes one of a secondary light emitting device, where each secondary light emitting device includes a plurality of light emitting diodes which expose one of a plurality of photosensitive members, a secondary laser emitting member and a secondary deflector for the secondary color, where the secondary laser emitting member emits a different laser beam for each secondary color, based on image data for each secondary color, and the secondary deflector deflects each of the different laser beams such that each of the different laser beams is directed to a photosensitive member associated with each secondary color.

According to another aspect of the invention, a smaller and lower cost tandem-type image forming apparatus is provided.

According to another aspect of the invention, an image forming apparatus capable of being manufactured at a lower cost and in a reduced size, as compared to known image forming apparatus, while having high quality monochrome printing capability, is provided.

According to another aspect of the invention, an image forming apparatus includes a process device which can be replaced without adversely affecting other process devices.

According to another aspect of the invention, a main body of an image forming apparatus includes a recording medium holder that holds recording medium on which an image is to be recorded, where the recording medium holder is removable from a first side of the main body, and a primary process device is removable/replaceable by opening a cover or panel disposed on the first side of the main body.

According to another aspect of the invention, a main body of an image forming apparatus includes, on a top surface thereof, a recording medium discharge portion that ejects a recording medium on which an image has been formed, after being conveyed along a processing path of the image forming apparatus including a plurality of process devices.

According to another aspect of the invention, an exposure device for a primary color is provided separately from a process device for the primary color, and the exposure device for the primary color is fixed to the top surface of a main frame of an image forming apparatus.

According to another aspect of the invention, a primary process device and secondary process devices for colors other than the primary color are arranged along a direction where a recording sheet is conveyed, and the primary process device is disposed on an upstream side, such that the primary process device is the farthest separated from a fixing device disposed on a most downstream side with respect to the direction in which the recording sheet is conveyed.

These and other optional features and possible advantages of various aspects of this invention are described in, or are apparent from, the following detailed description of exemplary embodiments of systems and methods which implement this invention.

BRIEF DESCRIPTION OF THE DRAWINGS

Embodiments of the invention will be described in detail with reference to the following figures wherein.

DETAILED DESCRIPTION OF EXEMPLARY EMBODIMENTS

A first exemplary embodiment of one or more aspects of the invention will be described in detail with reference to FIGS. 1-4.

Figure 1:
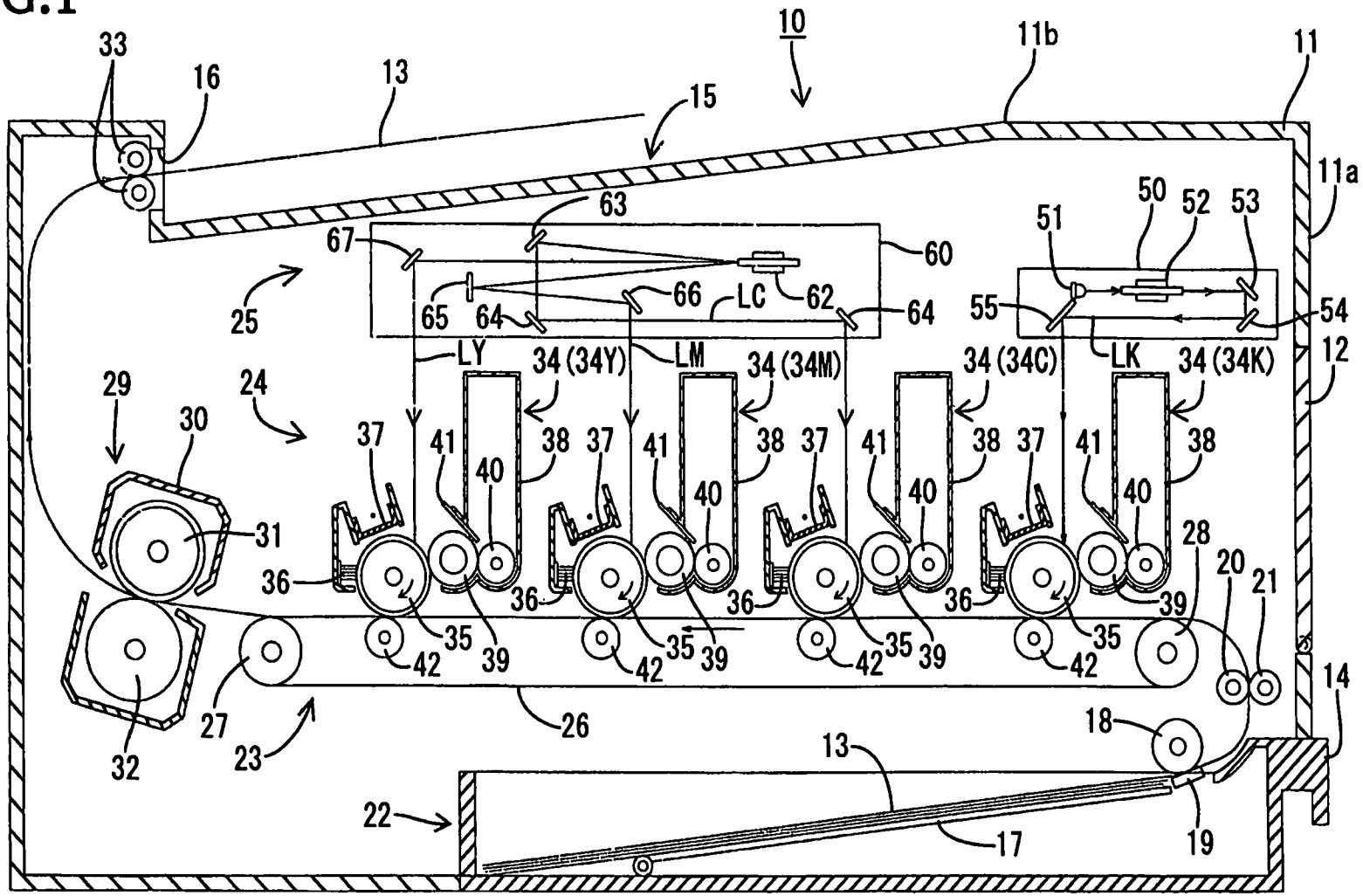
FIG. 1 is a cross-sectional view of an internal structure of an exemplary color laser printer as an example of image forming apparatus according to a first combination of one or more aspects of the invention.

A cross-section of an exemplary tandem type color laser printer 10 (i.e., image forming apparatus) employing one or more aspects of the invention is illustrated in FIG. 1. The exemplary color laser printer 10 includes four photosensitive drums 35, each corresponding to one of black, cyan, magenta, and yellow. In the following description, the right-hand side of each drawing is regarded as a front side of the image forming apparatus and the left-hand side of each drawing is regarded as a rear side of the image forming apparatus.

In the following description of various embodiments of the invention, the color black will be utilized as an example of a primary color and thus, a black process cartridge, etc. will be referred to as an example of a primary process cartridge. Further, in the following description colors other than black will be referred to as secondary colors in view of the exemplary use of the color black as a primary color. However, any color may be a primary color and black may be a secondary color in various embodiments of one or more aspects of the invention. The words primary and secondary are solely utilized to identify different components of an image forming apparatus employing one or more aspects of the invention.

As shown in FIG. 1, the exemplary color laser printer 10 employing one or more aspects of the invention is provided with a front cover 12 which is rotatably supported at a lower end portion thereof by a front face 11*a* of a main body 11. Under the front cover 12, a recording medium cassette 14 for holding, for example, a stack of sheets 13 is provided. The recording medium cassette 14 is provided so as to be slidable and detachable from the front face 11*a*.

An output tray 15, which inclines downwardly such that the front side is at a level higher than the back side thereof, is provided on a top surface 11*b* of the main body 11. Recording medium sheets 13, which have undergone a printing process, are ejected from a sheet discharge slot 16 formed at the rear side of the output tray 15 and stacked on the output tray 15 one by one.

Figure 3:
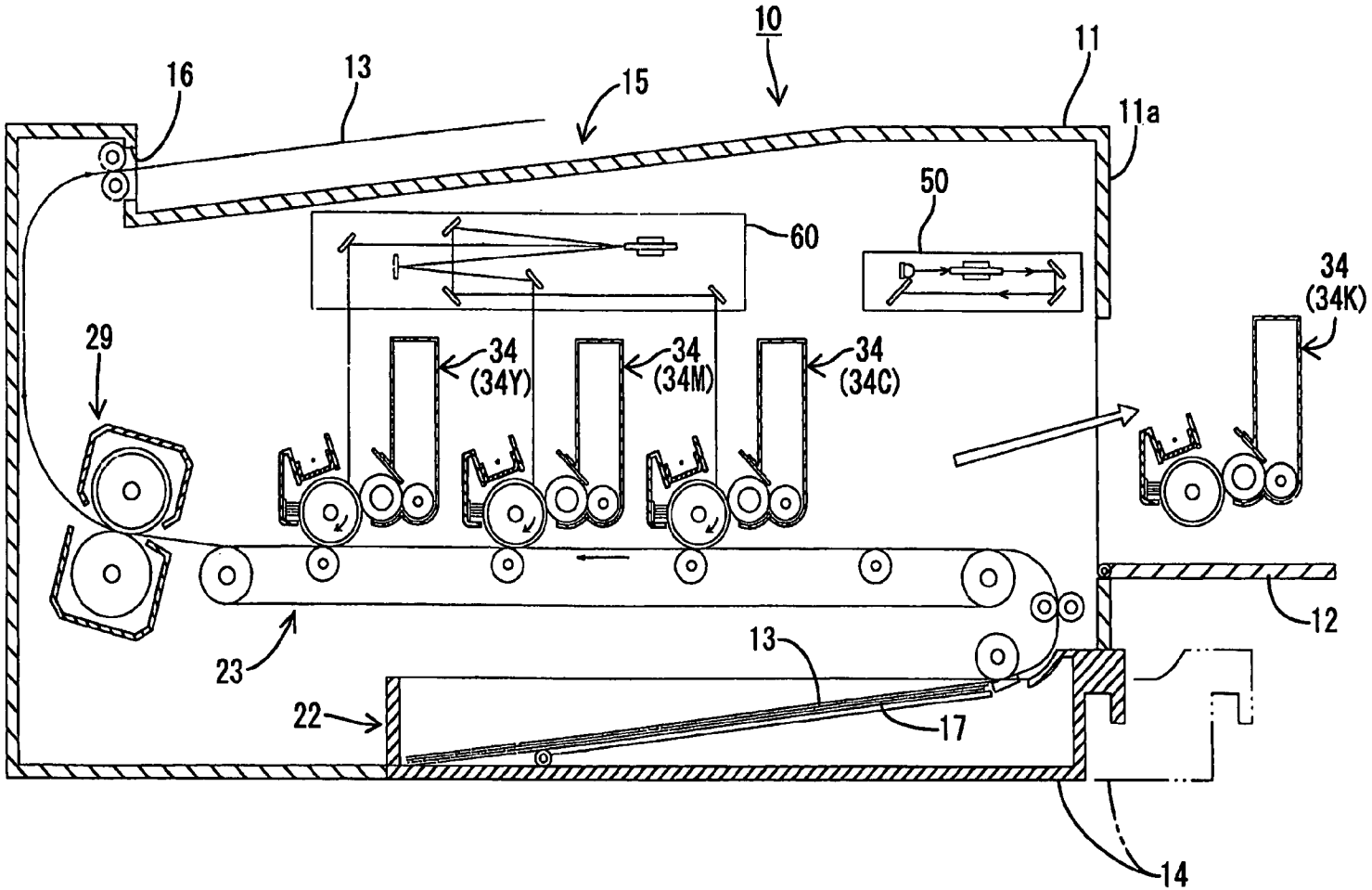
FIG. 3 is a cross-sectional view of the exemplary color laser printer illustrated in FIG. 1 in a state where a black process cartridge, as an exemplary primary process cartridge, has been removed therefrom.
Figure 4:
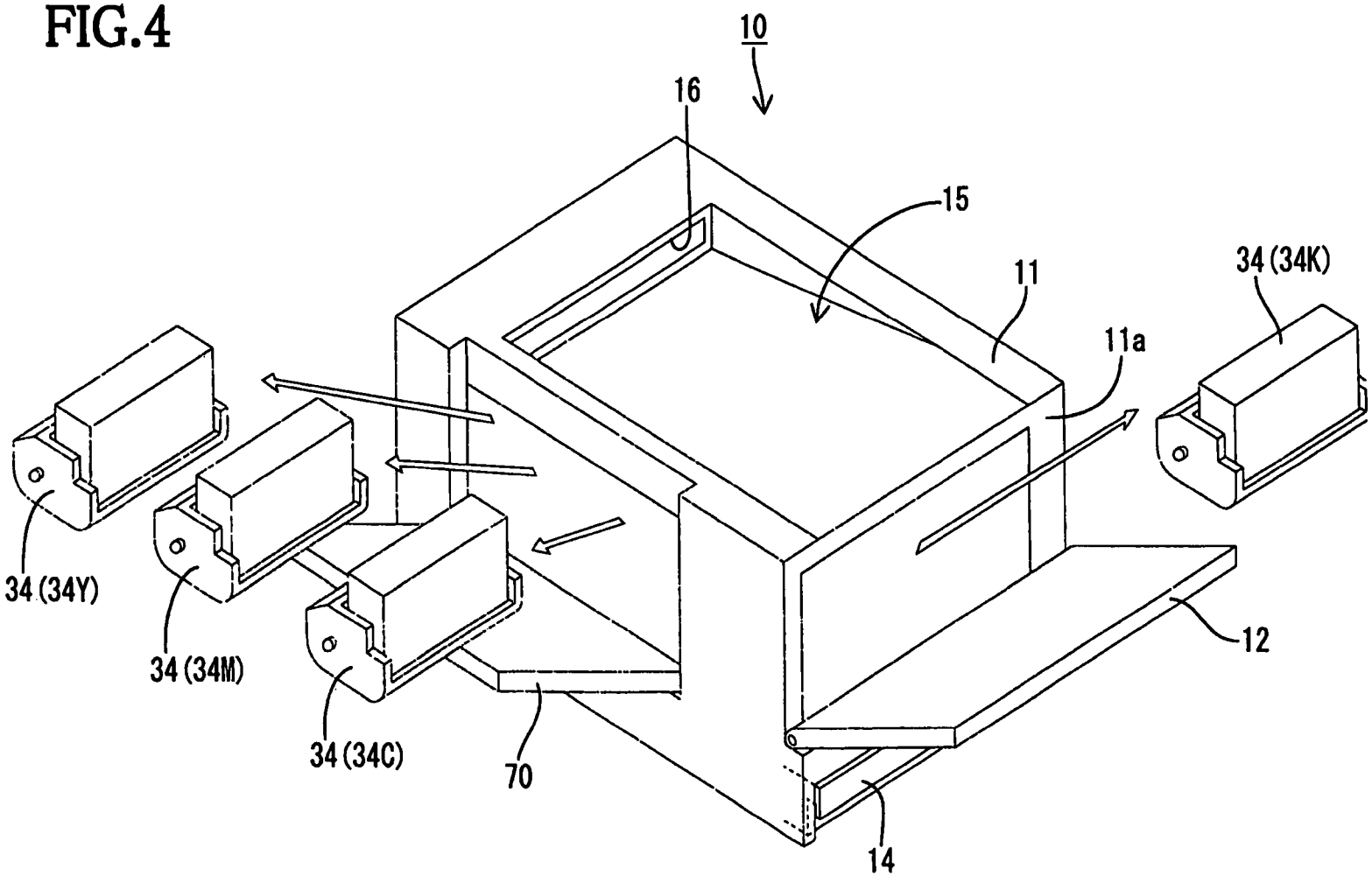
FIG. 4 is a perspective view of the exemplary color laser printer illustrated in FIG. 1 in as state where all process cartridges have been removed therefrom.

As shown in FIG. 3, when the front cover 12 is opened or removed, the primary process cartridge (e.g., 34K) may be removed from the exemplary color laser printer 10. As shown in FIG. 4, there is provided an exemplary side cover 70, which is rotatably supported at a lower end portion thereof, at one side of the main body 11. When the side cover 70 is opened or removed, secondary process cartridges (e.g., 34C, 34M, and 34Y) can be removed from the color laser printer 10.

Referring back to FIG. 1, the color laser printer 10 includes, in the main body 11 thereof, a sheet supply portion 22, which includes the recording medium cassette 14, a sheet conveying portion 23, which is provided above the sheet supply portion 22, an image forming part 24, which is arranged along the sheet conveying portion 23, and a laser scanner 25, which is provided above the image forming part 24.

A paper pressing plate 17 is provided at a bottom of the recording medium cassette 14. The paper pressing plate 17 is pivotally supported at its rear end and is urged upwardly at its front end by a spring (not shown). When recording medium sheets 13 are stacked in the recording medium cassette 14, the recording medium sheets 13 are urged upward by the paper pressing plate 17 which is provided at the bottom of the recording medium cassette 14.

A feed roller 18 and a separating pad 19 are disposed so as to face each other. The separating pad 19 is pressed toward the feed roller 18 by a spring (not shown), which is disposed on the back side of the separating pad 19.

The uppermost recording medium sheet 13 of the stack on the recording medium cassette 14 is pressed against the feed roller 18 by the urging force of the paper pressing plate 17. Upon the rotation of the feed roller 18, the leading edge of the uppermost recording medium sheet 13 is pinched between the feed roller 18 and the separating pad 19, and a sheet of the recording medium is separated from the stack via the combination of the feed roller 18 and the separating pad 19.

The recording medium sheet 13 supplied from the recording medium cassette 14 is fed toward sheet conveying portion 23 after dust accumulated thereon is removed by a pair of dust removing rollers 20, 21.

In the color laser printer 10, the sheet conveying portion 23 includes a driving roller 27 and a driven roller 28, which are aligned along the front-rear direction of the main body 11 of the color laser printer 10. The driving roller 27 is provided towards the back of the color laser printer 10 while the driven roller 28 is provided towards the front of the color laser printer. An endless (i.e., closed surface) belt 26 is stretched between the driving roller 27 and the driven roller 28. The belt 26 is supported by the driving roller 27 and the driven roller 28 and is driven/rotated thereby.

The recording medium sheet 13 fed from the pair of dust removing rollers 20, 21 is conveyed from almost the front face 11*a* (i.e., upstream side of the sheet feeding direction) of the main body 11 to almost the rear face (i.e., downstream side of the sheet feeding direction) by the sheet conveying portion 23, as indicated by the arrow in FIG. 1. Transfer rollers 42 are provided on along an inner side of the belt 26 and each transfer roller 42 is arranged substantially below one of the respective photosensitive drums 35 of each process cartridge 34 with the belt 26 substantially sandwiched therebetween. In the color laser printer 10, four transfer rollers 42 are provided.

A fixing unit 29 is provided at a downstream side of the sheet conveying portion 23. The fixing unit 29 includes a heat roller 31 and a pressure roller 32, which are assembled in a casing 30 made of a thermal insulating material. An image transferred onto the sheet 13 is fixed by heat and pressure while the sheet 13 passes between the heat roller 31 and the pressure roller 32 at the fixing unit 29. Thus, the sheet 13 on which the image has been fixed is ejected from the sheet discharge slot 16 via a pair of ejection rollers 33, and stacked on the output tray 15.

The image forming part 24 includes, for example, four process cartridges 34 provided and each process cartridge, in this exemplary embodiment, processes one of four colors (black, cyan, magenta, and yellow) for image formation. The process cartridges 34 include a black process cartridge 34K, a cyan process cartridge 34C, a magenta process cartridge 34M, and a yellow process cartridge 34Y. The exemplary process cartridges 34C, 34K, 34Y, 34M are sequentially disposed in this exemplary order and at a specified distance away from each other so as to be aligned with, each other along the sheet feed direction of the sheet conveying portion 23. In the color laser printer 10 illustrated in FIG. 1, the black process cartridge 34K is disposed on the most upstream side with respect to the sheet feed direction. Hereinafter, in the following description, numeral 34 will be used to refer to the four process cartridges as a whole.

In the color laser printer 10, the process cartridges 34 are identical in shape, structure and operation except that each contains a different color of toner. Each of the process cartridges 34 includes, for example, a photosensitive drum 35, a cleaner 36, a charger 37, and a developing device 38. As illustrated in FIG. 1, the cleaner 36, the charger 37 and the developing device 38 are disposed around the photosensitive drum 35.

The developing device 38 serves as a toner housing container and forms a front-side casing of each process cartridge 34. The photosensitive drum 35, the cleaner 36, and the charger 37 are supported by a rear-side casing of the process cartridge 34.

The developing device 38 contains a color toner therein and rotatably supports a developing roller 39 at a lower opening thereof. To supply toner to the developing roller 39, the developing roller 39 is pressed into contact with a supply roller 40 and upon the rotation of the supply roller 40, toner is rubbed against and supplied to a peripheral surface of the developing roller 39.

A blade 41 in the form of a flexible-plate makes contact with the peripheral surface of the developing roller 39. The blade 41 supplies an electrical charge to toner by friction in order to improve adherence of the toner to the developing roller 39, and regulates the amount of toner adhered to the developing roller 39 to a specified thickness.

The laser scanner 25 includes a laser scanner 50 associated with the primary process cartridge (e.g., black process cartridge 34K) and a laser scanner 60 associated with secondary process cartridges (e.g., cyan, magenta and yellow process cartridges 34C, 34M, 34Y). In the following description of the color laser printer 10, the black process cartridge, etc. will be used as an example of the primary process cartridge and colors other than black will be used as an example of secondary colors. However, in some embodiments of one or more aspects of the invention, the primary process cartridge may process a color other than black and a secondary process cartridge may process black. Further, in the following description, components of the color laser printer 10 which are associated with the primary color will be identified as primary components and components of the color laser printer 10 which are associated with secondary colors will be identified as secondary components. The words primary and secondary are solely utilized in the following description to identify the different components.

The primary laser scanner 50 directs a laser beam LK to the photosensitive drum 35 associated with the primary cartridge (e.g., black cartridge). The secondary laser scanner 60 for the secondary colors directs each of laser beams LC, LM, LY to a corresponding one of the photosensitive drums 35 for the secondary colors (e.g., cyan, magenta, and yellow).

In the color laser printer 10 illustrated in FIG. 1, the primary laser scanner 50 associated with the primary process cartridge (e.g., 34K) is fixed, for example, to an upper portion of the main body 11, and includes a laser emitting portion 51, a polygon mirror 52, lenses (not shown), and mirrors 53, 54, 55. The laser beam LK, which is modulated based on primary color image data, is emitted from the laser emitting portion 51, and sequentially passes through or deflects from the polygon mirror 52, the lenses and the mirrors 53, 54, 55. The laser beam LK is then directed to the surface of the photosensitive drum 35 associated with the primary process cartridge (e.g., black process cartridge 34K). Thereby, an electrical latent image corresponding to the primary color image data (e.g., black) is formed on the surface of the photosensitive drum 35 associated with the primary process cartridge (e.g., 34K), which is uniformly charged by the charger 37.

In some embodiments, a hologram, a galvanized mirror or a plurality of galvanized mirrors which are rotated and/or an acoustic-optic modulator may be used, for example, instead of the polygon mirror 52.

Figure 2:
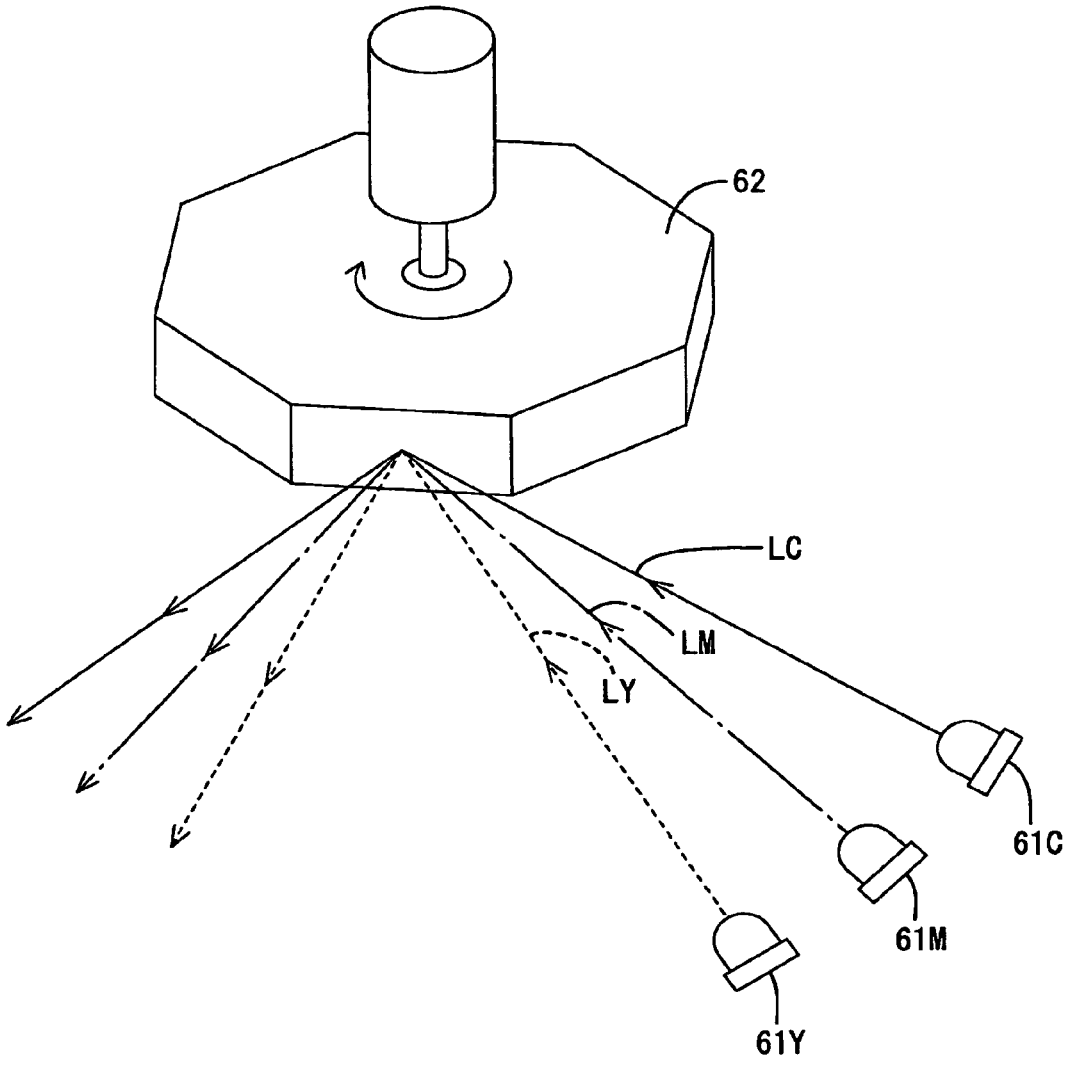
FIG. 2 is a perspective view of a structure of a laser scanner for secondary colors which may be employed in the color laser printer illustrated in FIG. 1 according to one or more aspects of the invention.

The secondary laser scanner 60 for secondary colors is fixed, for example, to an upper portion of the main body 11. As shown in FIGS. 1 and 2, the secondary laser scanner 60 includes, for example, three laser emitting portions 61C, 61M, 61Y that emit laser beams LC, LM, LY, which are modulated based on each secondary color image data (e.g., cyan color image data, magenta color image data, and yellow color image data), respectively. The laser beams LC, LM, LY emitted from the three laser emitting portions 61C, 61M, 61Y are designed to fall on a single polygon mirror 62 at different incident angles with respect to each other.

In some embodiments of one or more aspects of the invention, a hologram, a galvanized mirror or a plurality of galvanized mirrors which are rotated, and/or an acoustic-optic modulator may be used, for example, instead of the polygon mirror 62.

Each of the laser beams LC, LM, LY deflected on the polygon mirror 62 passes through or deflects from lenses (not shown) and deflecting mirrors 63, 64, 65, 66, 67, and is directed to the surface of the photosensitive drum 35 associated with one of the process cartridges 34C, 34M, 34Y. Thereby, an electrostatic latent image corresponding to each of the cyan color image data, the magenta color image data, and the yellow color image data is formed on the surface of the respective photosensitive drum 35, each of which is uniformly charged by the charger 37 associated therewith.

The electrostatic latent image formed on the surface of the photosensitive drum 35 of each process cartridge 34 is developed by a specified color contained in the developing device 38 associated with the process cartridge, and the formed electrostatic latent image is transferred onto the sheet 13 by the transfer roller 42. Thus, the black color image, the cyan color image, the magenta color image, and the yellow color image are overlaid one over the other onto the sheet 13 conveyed on the belt 26 of the sheet conveying portion 23, and a full-color image is formed on the sheet 13.

As shown in FIGS. 3 and 4, one of the process cartridges, which will be referred to as the primary process cartridge (e.g., black process cartridge 34K) is detachable from the front face 11*a* of the main body 11 when the front cover 12, provided on the front face 11*a*, is removed or opened.

As shown in FIG. 4, the other process cartridges, which will be referred to as secondary process cartridges (e.g., cyan, magenta, and yellow process cartridges 34C, 34M, 34Y) are detachable and removable when the side cover 70, provided on one side of the main body 11, is removed or opened. Thus, the secondary process cartridges (e.g., cyan, magenta, and yellow process cartridges 34C, 34M, 34Y) may be removed, for example, when the respective process cartridge is pulled along a direction which is substantially perpendicular to the removal direction of the primary process cartridge (e.g., 34K).

In the first exemplary embodiment of the color laser printer 10, two laser scanners (i.e., the primary laser scanner 50 and the secondary laser scanner 60) are provided. The primary laser scanner 50 is employed to direct the laser beam LK to the photosensitive drum 35 corresponding to the primary color (e.g., black), and the secondary laser scanner 60 is employed to direct, for example, the laser beams LC, LM, LY to the photosensitive drums 35 corresponding to the secondary colors (e.g., cyan, magenta, and yellow). Thus, compared with a device disclosed in U.S. Pat. No. 5,784,094, the design of optical system is simplified and high-quality monochrome printing, which is often used, can be maintained.

The laser beams LC, LM, LY corresponding to cyan, magenta, and yellow respectively, are deflected by the single polygon mirror 62. Thus, the color laser printer 10 can be reduced in size as compared with a conventional tandem-type color laser printer where the deflection devices are provided in accordance with each color. In addition, the number of optical systems to be adjusted is one fewer than the number of optical systems to be adjusted in the device disclosed in U.S. Pat. No. 5,784,094 where all laser beams corresponding to each color are deflected by a single polygon mirror (because the laser beam for black color is omitted), so that adjustment of the laser spot position with respect to each photosensitive drum 35 is simplified compared thereto.

According to the first embodiment, as shown in FIG. 4 and as discussed above, the primary process cartridge (e.g., 34K) is detachable by opening the front cover 12 provided on the front face 11*a* of the main body 11, whereas the secondary process cartridges (e.g., cyan, magenta, and yellow process cartridges 34C, 34M, 34Y) are detachable by opening the side cover 70 provided on one side of the main body 11. Thus, when the primary process cartridge (e.g., 34K) is replaced, the removal/replacement process does not impact the positioning of the secondary process cartridges (e.g., cyan, magenta, yellow process cartridges 34C, 34M, 34Y). Accordingly, deterioration of image quality can be reduced, and preferably prevented, by reducing, and preferably eliminating, adverse movement of the positional states of the cyan, magenta, yellow process cartridges 34C, 34M, 34Y.

When a process cartridge is unintentionally moved, for example, during replacement of an adjacent process cartridge, the quality of an image formed by the image forming device may be adversely affected. The unintentional movement of the process cartridge can result, for example, in deviation of the laser spot position of the laser beam emitted from the secondary laser scanner 60 associated with the secondary colors on the respective photosensitive drums 35 and deviation of the relative position between the respective photosensitive drum 35 and developing roller 39.

In the exemplary embodiment of the color laser printer 10 described above where the primary process cartridge (e.g., 34K) can be removed from the front cover 12 and the secondary process cartridges (e.g., 34C, 34M and 34Y) for the secondary colors can be removed from a side of the printer 10, when any of the secondary process cartridges (e.g., cyan, magenta, yellow process cartridges 34C, 34M, 34Y) are replaced, the primary process cartridge (e.g., 34K) is not affected. Thus, at least deterioration in the image quality of primary color images can be reduced, and preferably prevented, by reducing, and preferably preventing an adverse impact on the positional state of the primary process cartridge (e.g., 34K).

Generally, during the life of color laser printers, such as the color laser printer 10 illustrated in FIG. 1, replenishment of the recording medium sheets 13 in the recording medium cassette 14 is the most frequent maintenance operation performed. The color laser printer 10 is generally placed such that a face from which the recording medium cassette 14 is pulled out is orientated toward a direction which would allow the user to easily replenish the supply of the recording medium (e.g., paper). Next, in the list of most common maintenance operations is generally black toner replacement as black toner is generally consumed more than other toner colors, and thus the black process cartridge 34K is most frequently replaced. However, in some embodiments of one or more aspects of the invention, a color other than black may be used more frequently and/or black may not be used at all. Thus, while it is generally desirable to make maintenance operations as easy as possible for the user, it is also desirable to allow easy access to the components which are to be replaced more often, e.g., sheets and black process cartridge 34K.

In the first embodiment of the color laser printer 10 illustrated in FIG. 1, the recording medium cassette 14 is provided on the front face 11*a* of the main body 11 such that it can be pulled out from the front face 11*a*. Further, when the front cover 12 provided on the front face 11*a* is open, the most-frequently used process cartridge (e.g., 34K) can be removed and attached. Thus, replacement of most-frequently used process cartridge (e.g., 34K) and replenishment of the recording medium sheets 13 in the recording medium cassette 14 can be performed from the front face 11*a* of the color laser printer 10, which can help simplify the maintenance operations of sheet and black process cartridge replacement.

Further, a printed recording medium sheet 13 can be taken out from the output tray 15 provided on the top face 11*b* of the main body 11, which can further increase the user convenience.

In the first exemplary embodiment of the color laser printer 10 according to one or more aspects of the invention, the primary laser scanner 50 is provided separately from the primary process cartridge (e.g., 34K), and is fixed to the main body 11. Thus, when the primary process cartridge (e.g., 34K) is replaced, variation in the optical position of the primary laser scanner 50 can be minimized, and preferably prevented. In the exemplary embodiment illustrated in FIG. 1, the output tray 15 is provided on the upper face 11*b* that is not used for replacement of the process cartridges 34 and/or attachment and removal of the recording medium cassette 14. Thus, it is possible, for example, to replace the process cartridges 34 with the sheets 13 loaded on the output tray 15. In some embodiments of one or more aspects of the invention, the primary and/or secondary laser scanners 50, 60 may be provided on a face/side of the printer which is not needed to be opened/closed often (i.e., not on a face which may be opened or closed to replace the primary/secondary process cartridge) in order to avoid unnecessary movement thereof.

In the first exemplary embodiment according to one or more aspects of the invention, the primary process cartridge (e.g., 34K) and the primary laser scanner 50 are arranged on the upstream side from the secondary process cartridges (e.g., cyan, magenta and yellow process cartridges 34C, 34M, 34Y), which is the farthest separated from the fixing device 29 disposed on the most downstream side with respect to the sheet feed direction of the sheet conveying portion 23. This arrangement can preferably prevent the optical system that forms the primary laser scanner 50 (such as lenses and mirrors) from becoming distorted by heat dissipating from the fixing device 29, as much as possible.

A second exemplary embodiment of one or more aspects of the invention will be described in relation to a color laser printer 80 with reference to FIGS. 5 to 7. It is noted that elements similar to or identical with those in the first exemplary embodiment are designated by similar numerals, and thus the description thereof is omitted for the sake of brevity. Only major differences with the aforementioned embodiment will be described.

Figure 5:
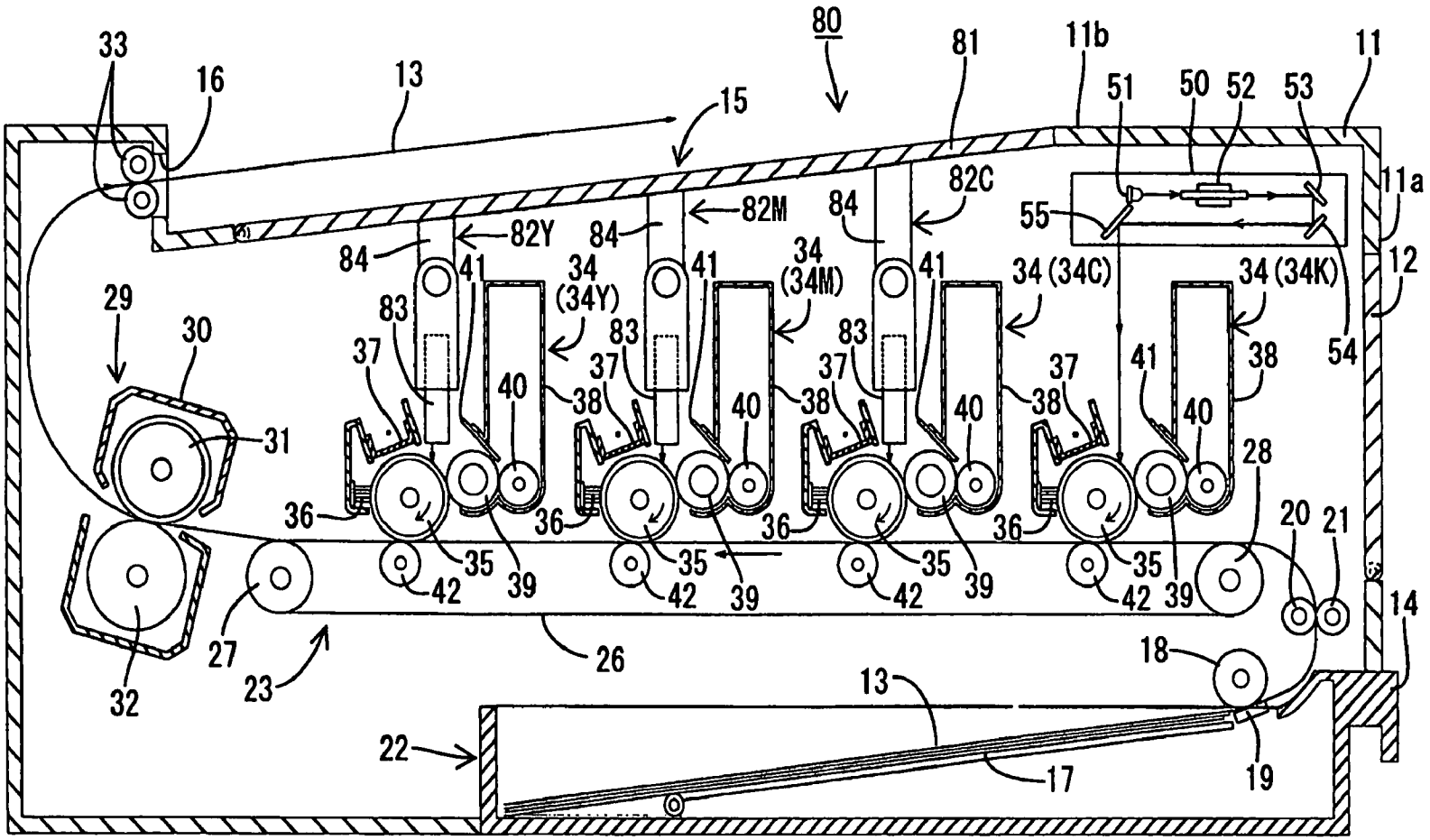
FIG. 5 is a cross-sectional view of an internal structure of a color laser printer, as another example of an image forming apparatus, employing a different combination of one or more aspects of the invention.

FIG. 5 shows an internal structure of the color laser printer 80 of the second exemplary embodiment of one or more aspects of the invention.

In the color laser printer 80 of the second embodiment, a top cover 81 is formed on the top face 11*b* of the main body 11. The top cover 81 is pivotable near the sheet discharge slot 16. With the top cover 81 closed, the sheets 13, which have been ejected from the sheet discharge slot 16, may be stacked on the top cover 81. On the underside of the top cover 81, LED exposure devices for secondary colors (e.g., cyan 82C, magenta 82M, and yellow 82Y) are provided as light exposure devices for the secondary colors.

Each of the LED exposure devices (e.g., 82C, 82M, and 82Y) includes an LED array 83 having a plurality of light-emitting diodes arranged in a line along a direction perpendicular to the sheet feed direction of the sheet conveying portion 23. The LED array 83 is fixed to the underside of the output tray 15 via support members 84 capable of being inclined. Light produced by each of the light emitting diodes is directed toward the corresponding photosensitive drum 35 located underneath.

Each of the LED exposure devices (e.g., 82C, 82M, and 82Y) performs on-off control of the light-emitting diodes based on image data corresponding to its respective secondary color (cyan, magenta, and yellow), and irradiates light onto the surface of the corresponding photosensitive drum 35. Thereby, the electrostatic latent images corresponding to the image data of each of the secondary colors (cyan, magenta, and yellow) are formed on the respective photosensitive drums 35.

Figure 6:
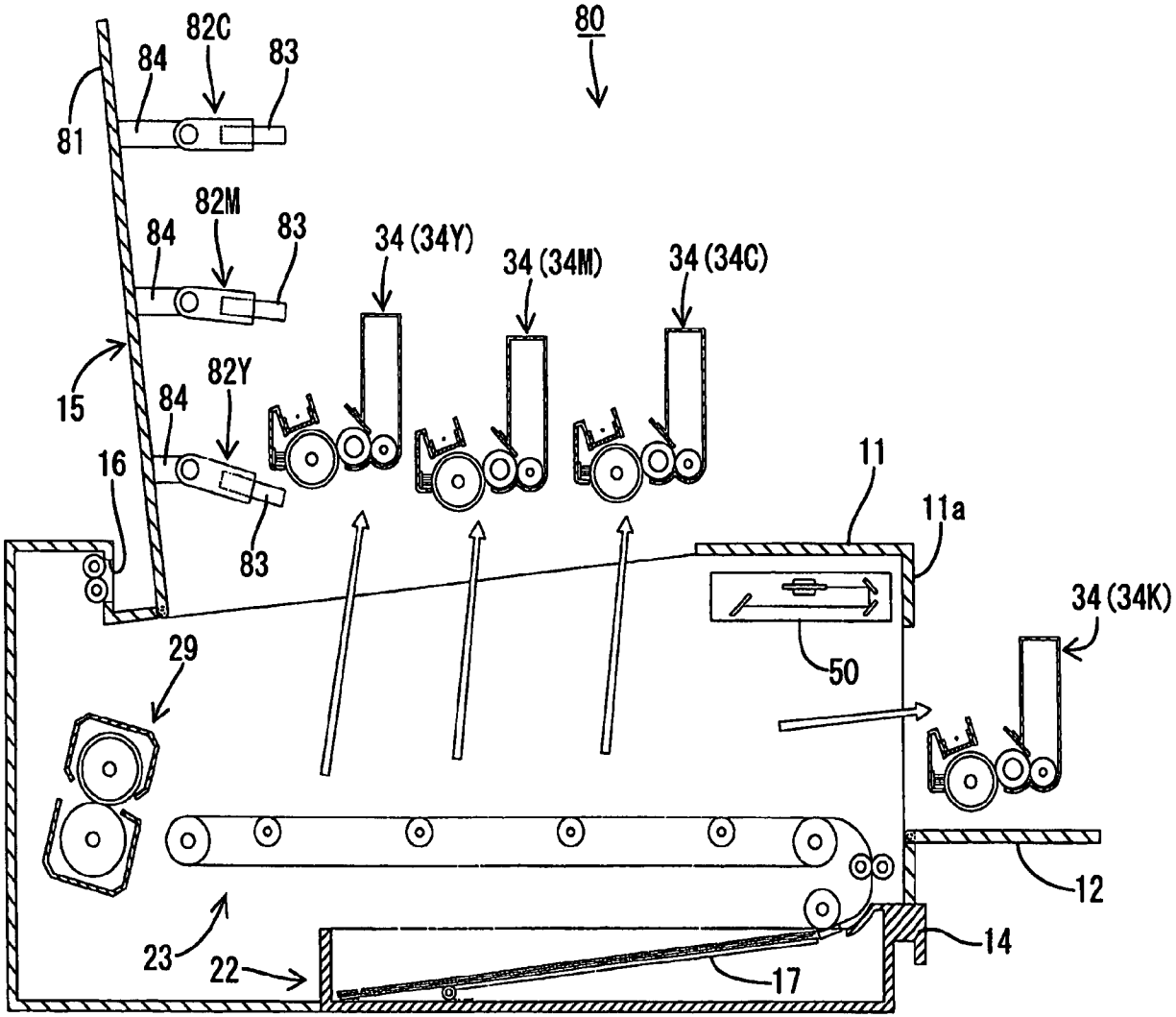
FIG. 6 is a cross-sectional view of the exemplary color laser printer illustrated in FIG. 5 in a state where all process cartridges have been removed therefrom.
Figure 7:
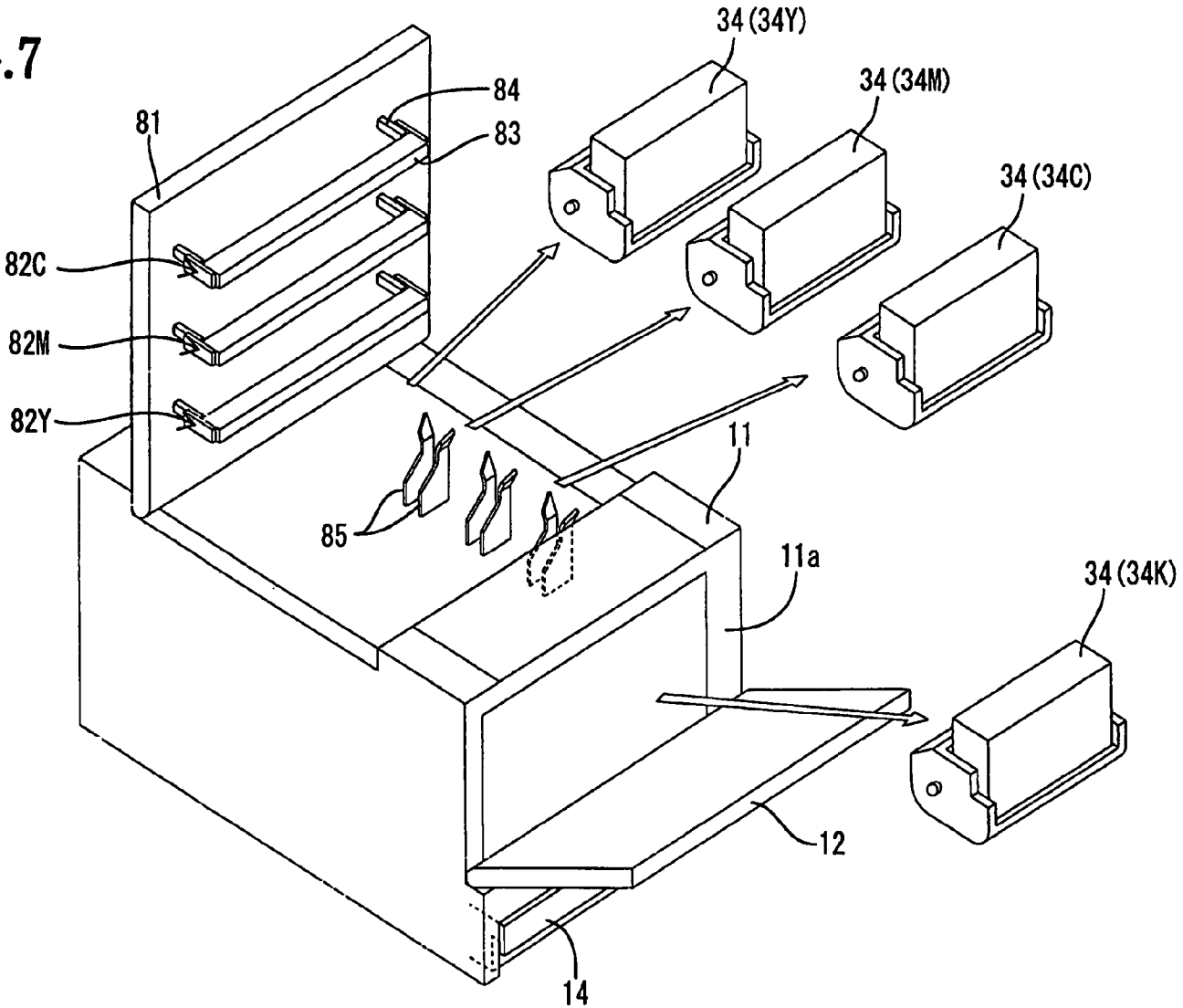
FIG. 7 is a perspective view of the exemplary color laser printer illustrated in FIG. 5 in a state where all process cartridges have been removed therefrom.

In the second embodiment of one or more aspects of the invention, as shown in FIGS. 6 and 7, the primary process cartridge (e.g., 34K) is detachable when the front cover 12 provided on the front face 11*a* of the main body 11 is open, whereas the secondary process cartridges (e.g., cyan, magenta, and yellow process cartridges 34C, 34M, 34Y) are detachable when the top cover 81 provided on the top face 11*b* of the main body 11 is open.

Guide walls 85 are provided, for example, in pairs on an inner side wall of the main body 11 and the guide walls 85 are provided for each of the LED exposure devices (e.g., 82C, 82M, and 82Y). When the top cover 81 is being closed, the LED array 83 of each of the LED exposure devices (e.g., 82C, 82M, and 82Y) is guided between a corresponding pair of the guide walls 85 and thus, the LED array 83 of each of the LED exposure devices (e.g., 82C, 82M, and 82Y) is maintained in a position facing the corresponding one of the photosensitive drums 35.

In the second exemplary embodiment of one or more aspects of the invention, a laser beam modulated based on the primary image data is emitted from the primary laser scanner 50, the modulated laser beam is deflected by the exclusive polygon mirror 52, and then directed on the photosensitive drum 35 associated therewith, and the primary color electrostatic latent image is thereby formed on the photosensitive drum 35 associated therewith. Thus, at least high quality of monochrome printing, which is generally most frequently used, can be maintained.

As to the secondary colors, light is emitted from the LED exposure devices (e.g., 82C, 82M, 82Y) and each exposure device (e.g., 82C, 82M, 82Y) includes a plurality of light-emitting diodes arranged in a line, and directed to the corresponding photosensitive drums 35, and the electrostatic latent image of each color is thereby formed on the corresponding photosensitive drum 35.

As LED exposure devices can be structured smaller in size than a laser scanner, the color laser printer 80 according to second exemplary embodiment can generally be made smaller in size than a printer employing a laser scanner for both the primary color and the secondary color. Further, as LED exposure devices do not employ a complicated optical system compared with the laser scanner, simplified design of the optical system is facilitated, and adjustment of the laser spot position with respect to each photosensitive drum 35 is comparatively simplified.

In the second exemplary embodiment, the output tray 15 is provided on the top face 11*b*. Thus, in the second exemplary embodiment, replacement of the primary process cartridge (e.g., 34K) can be performed with the sheets 13 loaded on the output tray 15.

Even with the second embodiment, it is clear that effects similar to those brought about by the first embodiment can be appreciated.

In the first and second embodiments, the process cartridges 34 are arranged parallel to each other along a front-rear direction of the main body 11 as shown in FIGS. 1 and 5. However, the invention is not limited to such an arrangement of process cartridges 34. In the main body 11, the process cartridges 34 may be disposed so as to be inclined to the right or left of FIGS. 1 and 5. In some embodiments, the process cartridges 34 may be disposed so as to overlap each other in a top-bottom direction, for example.

In the first and second embodiments, each process cartridge 34 includes the photosensitive drum 35, the charger 37, and the developing device 38. However, the invention is not limited to this structure. In some embodiments, the process cartridge 34 may also include the transfer roller 42. In some embodiments, the process cartridge 34 may be integrally provided with an exposure device (such as the primary laser scanner 50, the LED exposure devices (e.g., 82C, 82M, 82Y) and the secondary laser scanner 60) so as to be detachable with the exposure device. Furthermore, in some embodiments, the process cartridge 34 may only include the developing device 38.

In the first and second embodiments, the secondary process cartridges are provided separately. However, in some embodiments, they may be unified. In some embodiments, for example, the some of the secondary process cartridges may be unified (e.g., paired). In some embodiments of one or more aspects of the invention, there may be more than one primary process cartridge.

In the first and second embodiments, the descriptions are made as to the color laser printers 10, 80 having four color process cartridges for black, cyan, magenta, and yellow. In some embodiments, the color laser printers 10, 80 may be provided with seven process cartridges for seven colors of red, green, blue and the above four colors. In other embodiments, the color laser printers 10, 80 may include six process cartridges for six colors of light cyan, light magenta, and the above four colors, or black, cyan, magenta, red, green, and blue. In some embodiments, these six or seven process cartridges may be unified. In some embodiments, they may be unified by more than one process cartridge, such as two, three, or four cartridges each.

In the first embodiment, the secondary process cartridges are removable from a side of the main body 11. In the second embodiment, they are removable from the top face 11*b* of the main body 11. In some embodiments, a rear cover may be provided such that the secondary process cartridges can be removed from the rear side of the main body 11.

In various embodiments of one or more aspects of the invention, the primary process cartridge may be detachable from the top face 11*b* of the main body 11 and the secondary process cartridges may be detachable from the side of the main body 11.

In various embodiments of one or more aspects of the invention, the primary process cartridge may be detachable from the side of the main body 11 and the secondary process cartridges may be detachable from the top face 11*b* of the main body 11.

In various embodiments of one or more aspects of the invention, any arrangement of the process cartridges (primary and secondary) is possible. In various embodiments of one or more aspects of the invention, the process cartridges are arranged such that a surface where the secondary process cartridges are removed and attached and a surface where the primary process cartridge 34K is removed and attached are different (e.g., a first panel on one side is used for the primary process cartridge and a second panel on the same side is used for the secondary process cartridges).

Thus, while this invention has been described in conjunction with the exemplary embodiments outlined above, it is evident that many alternatives, modifications and variations will be apparent to those skilled in the art. Accordingly, the exemplary embodiments of these systems and methods according to this invention, as set forth above, are intended to be illustrative, not limiting. Various changes may be made without departing from the spirit and scope of this invention.

What is claimed is:

1. An image forming apparatus, comprising:

a first exposure device, wherein the first exposure device includes at least one light emitting device, each of the at least one light emitting device is associated with one of a plurality of photosensitive members and includes a plurality of light emitting diodes, and light emitted from each of the at least one light emitting device exposes the photosensitive member associated therewith;

a first panel which is capable of being opened to access an internal space of the image forming apparatus, wherein the first exposure device is arranged on an inner surface of the first panel such that when the first panel is arranged on the image forming apparatus, the first exposure device is arranged within the internal space of the image forming apparatus; and a plurality of guide members, each of the plurality of guide members receiving and guiding one of the at least one light emitting device into position relative to the photosensitive member associated therewith when the first panel is arranged on the image forming apparatus.

2. The image forming apparatus of claim 1, wherein each of the plurality of guide members includes a pair of guiding projections with a predetermined space between the pairs of guiding projections, into which an end of one of the at least one light emitting device is arranged.

3. The image forming apparatus of claim 1, further comprising a plurality of process cartridges, each of the plurality of process cartridges being associated with one of the light emitting diodes and photosensitive members.

4. The image forming apparatus of claim 3, wherein the plurality of process cartridges are removable when the first panel is opened.

5. The image forming apparatus of claim 3, wherein one of the plurality of process cartridges which is associated with a most-frequently utilized color is removable from a second panel and is not removable from the first panel.

6. The image forming apparatus of claim 5, further comprising a second exposure device for processing image data of the most-frequently utilized color.

7. The image forming apparatus of claim 6, wherein the second exposure device includes a laser emitting member.

* * * * *